US010254716B2

(12) United States Patent
Renaud

(10) Patent No.: US 10,254,716 B2
(45) Date of Patent: Apr. 9, 2019

(54) FLEXURAL PIVOT

(71) Applicant: DOMINIQUE RENAUD SA, Eysins (CH)

(72) Inventor: Dominique Renaud, Morges (CH)

(73) Assignee: DOMINIQUE RENAUD SA, Renens (CH)

( * ) Notice: Subject to any disclaimer, the term of this patent is extended or adjusted under 35 U.S.C. 154(b) by 44 days.

(21) Appl. No.: 15/326,903

(22) PCT Filed: Jul. 10, 2015

(86) PCT No.: PCT/EP2015/065884
§ 371 (c)(1),
(2) Date: Jan. 17, 2017

(87) PCT Pub. No.: WO2016/012281
PCT Pub. Date: Jan. 28, 2016

(65) Prior Publication Data

US 2017/0205768 A1 Jul. 20, 2017

(30) Foreign Application Priority Data

Jul. 21, 2014 (CH) ..... 1103/14

(51) Int. Cl.
*G04B 17/02* (2006.01)
*G04B 17/04* (2006.01)
(Continued)

(52) U.S. Cl.
CPC ..... *G04B 31/00* (2013.01); *G04B 17/02* (2013.01); *G04B 17/04* (2013.01); *G04B 31/02* (2013.01);
(Continued)

(58) Field of Classification Search
CPC ..... G04B 15/08; G04B 31/00; G04B 31/004; G04B 31/02; G04B 31/06; G04B 31/016;
(Continued)

(56) References Cited

U.S. PATENT DOCUMENTS 4,228,533 A * 10/1980 Siefert ..... G04B 45/0053 368/134
4,449,831 A * 5/1984 Itami ..... G04C 3/027 368/134
(Continued)

FOREIGN PATENT DOCUMENTS

DE 9765 C 5/1880
DE 276247 C 7/1914
(Continued)

OTHER PUBLICATIONS

Written Opinion of the International Search Authority dated Oct. 23, 2015, issued in corresponding International Application No. PCT/EP2015/065884, filed Jul. 10, 2015, 6 pages.
(Continued)

*Primary Examiner* — Daniel P Wicklund
(74) *Attorney, Agent, or Firm* — Christensen O'Connor Johnson Kindness PLLC

(57) ABSTRACT

A timekeeping pivot linking a first part with a second part, pivotably about a pivot axis, the pivot comprising a blade having an edge, rigidly connected to one of the first or second parts and the median plane of which passing via the edge defines a blade plane, and a bearing area rigidly connected to the other of the first and second parts and against which the edge of the blade bears, the contact points of the blade and of the bearing area being substantially situated on the pivot axis, the first and second parts being rigidly connected in translation in the direction orthogonal to the pivot axis contained in the blade plane.

15 Claims, 6 Drawing Sheets

Figure 1:
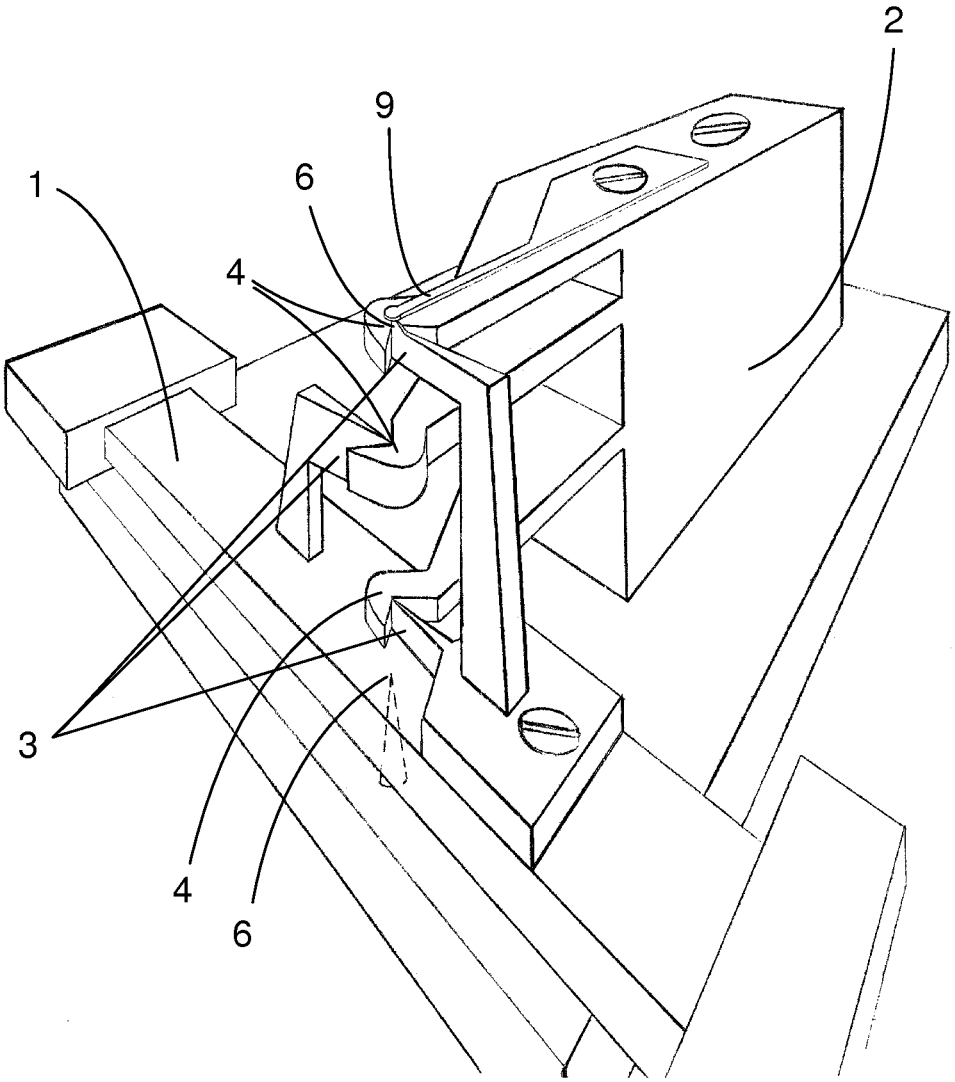

(51) Int. Cl.

| | |
|---|---|
| ***G04B 31/00*** | (2006.01) |
| ***G04B 31/02*** | (2006.01) |
| ***G04B 31/06*** | (2006.01) |
| ***G04B 37/04*** | (2006.01) |

(52) U.S. Cl.
CPC ..... *G04B 31/06* (2013.01); *G04B 37/0409* (2013.01); *G04B 37/0418* (2013.01)

(58) Field of Classification Search
CPC .... G04B 17/02; G04B 37/04; G04B 37/0409; G04B 37/0418
See application file for complete search history.

(56) References Cited

U.S. PATENT DOCUMENTS

| | | | | |
|---|---|---|---|---|
| 5,926,443 | A * | 7/1999 | Kitaura | G04C 3/00 368/165 |
| 7,572,050 | B2 * | 8/2009 | Bitterli | G04B 13/026 368/322 |
| 9,244,432 | B2 * | 1/2016 | Lagorgette | G04B 17/20 |
| 2008/0112276 | A1 * | 5/2008 | Bitterli | G04B 13/026 368/322 |
| 2010/0128574 | A1 * | 5/2010 | Hillis | G04B 17/02 368/179 |
| 2011/0205856 | A1 * | 8/2011 | Zaugg | G04B 13/025 368/185 |
| 2013/0070570 | A1 * | 3/2013 | Colpo | G04B 15/06 368/127 |
| 2015/0234354 | A1 * | 8/2015 | Henein | G04B 17/045 368/170 |
| 2016/0011566 | A1 * | 1/2016 | Stranczl | G04B 15/14 368/300 |

FOREIGN PATENT DOCUMENTS

| | | | |
|---|---|---|---|
| FR | 751784 | A | 9/1933 |
| GB | 2 204 159 | A | 11/1988 |
| GB | 2 307 315 | A | 5/1997 |

OTHER PUBLICATIONS

International Preliminary Report on Patentability dated Jan. 24, 2017, issued in corresponding International Application No. PCT/EP2015/065884, filed Jul. 10, 2015, 1 page.
International Search Report dated Oct. 23, 2015, issued in corresponding International Application No. PCT/EP2015/065884, filed Jul. 10, 2015, 2 pages.

* cited by examiner

FLEXURAL PIVOT

TECHNICAL FIELD

The present invention relates to the field of time-keeping. It more particularly relates to a pivot of the blade pivot type.

STATE OF THE ART

The making of pivots of the blade suspension type is known for pendulum clocks. The pendulum is secured to a prism, one edge of which is placed in a groove made in a support attached to the frame.

These pivots have low resistance to pivoting and for example contribute to improving the quality factor of this type of resonator.

However, these pivots cannot be used in a portable timekeeping part such as a watch since the prism is simply laid in the groove and would not remain in place if the axis of the pivot was no longer horizontal.

The object of the present invention is to propose a blade pivot for a timekeeping device which may be used regardless of the orientation of the axis of the pivot.

DISCLOSURE OF THE INVENTION

More specifically, and according to a first aspect, the invention relates to a timekeeping pivot pivotally connecting, around a pivot axis, a first part with a second part. The pivot includes a blade provided with a thin edge, secured to one of the first or second parts and a supporting area secured to one of the first and second parts and against which the thin edge of the blade is supported, the contact points of the blade and of the supporting area being substantially located on the axis of the pivot. The median plane of the blade passing through the thin edge defines a blade plane, the first and second parts are also secured in translation along the direction orthogonal to the axis of the pivot contained in the blade plane.

According to a second aspect, the invention also relates to a resonator including such a pivot.

According to a third aspect, the invention also relates to an oscillator including such a resonator.

SHORT DESCRIPTION OF THE DRAWINGS

Figures 2A, 2B:
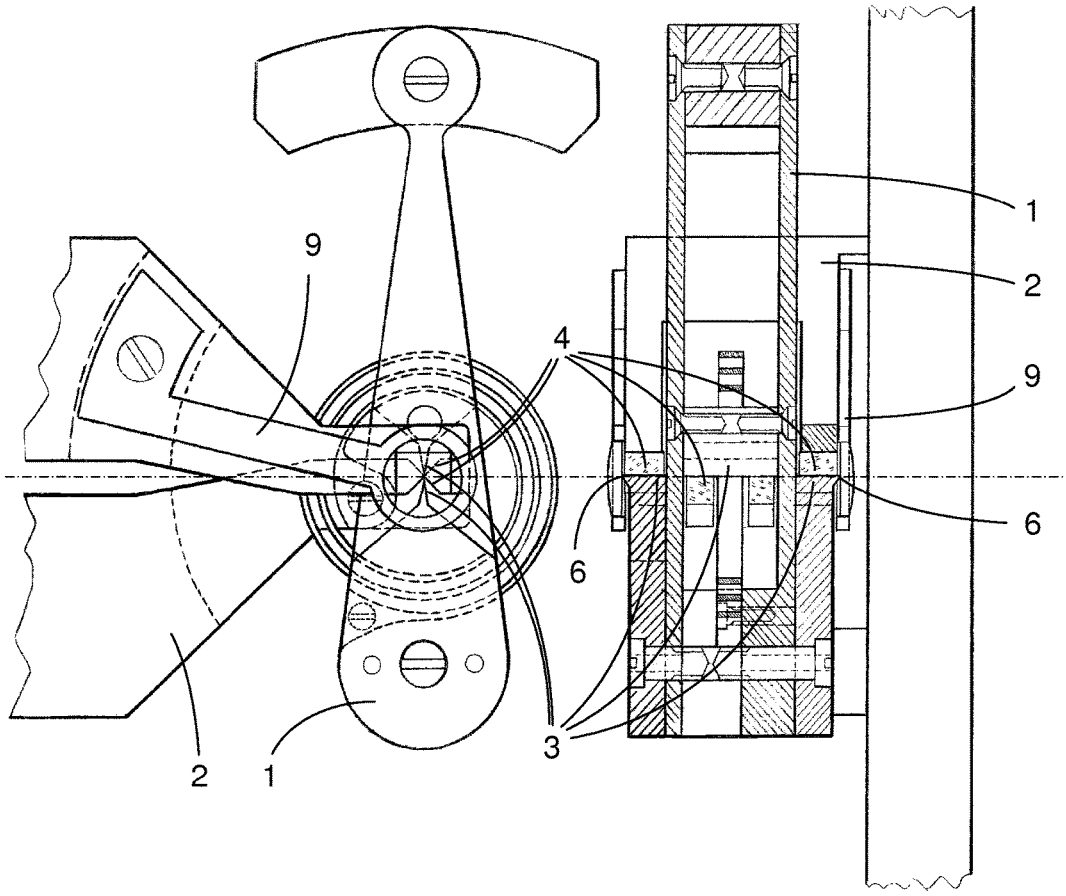
Figure 3:
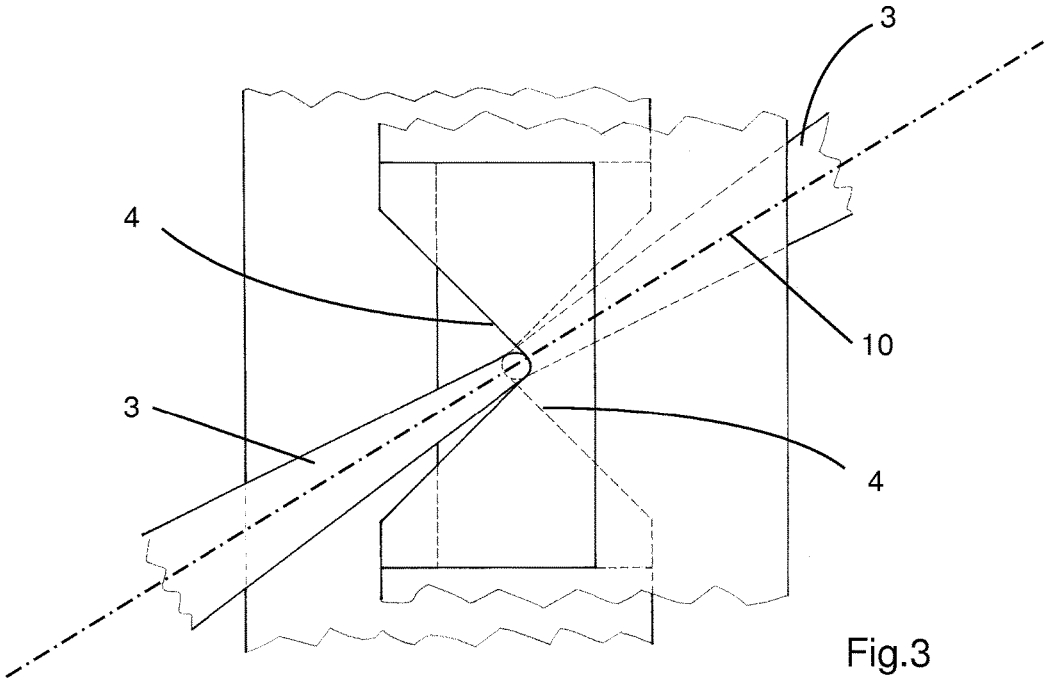

Other details of the invention will become more clearly apparent upon reading the description which follows, made with reference to the appended drawings wherein:

FIG. 1 illustrates a perspective view of a pivot according to an embodiment of the invention, FIGS. 2*a* and 2*b* illustrate a top view and a lateral sectional view of a pivot according to the invention, FIG. 3 illustrates a detailed view of a pivot according to an embodiment of the invention, FIGS. 4 to 8 illustrate pivots and resonators according to the invention.

The planes of FIGS. 2*a* and 3 to 6 are perpendicular to the axis of the pivot.

EMBODIMENT OF THE INVENTION

According to a first embodiment of a timekeeping blade pivot according to the invention illustrated in FIGS. 1, 2*a* and 2*b*, a first part 1 is pivotally mounted on a second part 2. The first part 1 includes three blades 3 including a thin edge which corresponds to the cutting portion of the blade

3. With each blade 3 is associated a blade plane 10 located in the median plane of the blade 3 and passing through the thin edge of the blade and the profile of which appears in FIG. 3. The three blades 3 are positioned in a same plane, the thin edges of the blades being aligned, both outer blades 3 being oriented in a same direction and the central blade 3 in the opposite direction.

The second part 2 includes three supporting areas formed with grooves 4 having a dihedron shape, mounted on three arms which the part 2 includes. The thin edges of the blades will be supported in the bottom of the grooves 4 which are aligned and define the axis of the pivot between the first 1 and second 2 parts. The opposition arrangement of the blades 3 and of the grooves 4 secured in translation to the first part 1 with the second part 2 along the directions contained in the plane orthogonal to the axis of the pivot and in particular in the direction contained in the blade plane 10 of the blades 3. The first 1 and second 2 parts are also secured in rotation along all the directions perpendicular to the axis of the pivot.

Limitation spikes 6 secured to one of the first 1 and second 2 parts and being supported on the other one of the first 1 and second 2 parts at the pivot axis, give the possibility of limiting the translational displacement along the axis of the pivot between the first 1 and second 2 parts. The contact of the spikes 6 with the other part being accomplished at the pivot axis, it provides a minimum resistance to the pivoting of the first 1 and second 2 parts.

Anti-impact devices including deformable blades 9 give the possibility of limiting the stresses applicable on the spikes 6 in order to protect them in the case of an impact. According to the embodiment shown in FIG. 2*b*, the limitation spikes 6 are integrated to the outer blades 3 and located at their external end and may bear against both stones borne by the deformable blades 9.

The first part 1 may thus pivot, according to a limited angular amplitude, relatively to the second part 2 around the pivot axis and this regardless of the orientation of the pivot axis relatively to the horizontal.

The first part may thus be a pendulum, to which it is possible to couple an elastic return member at the pivoting center of the first part 1. A spiral is illustrated in FIGS. 2*a* and 2*b*, but any other type of elastic member may be contemplated.

Figure 8:
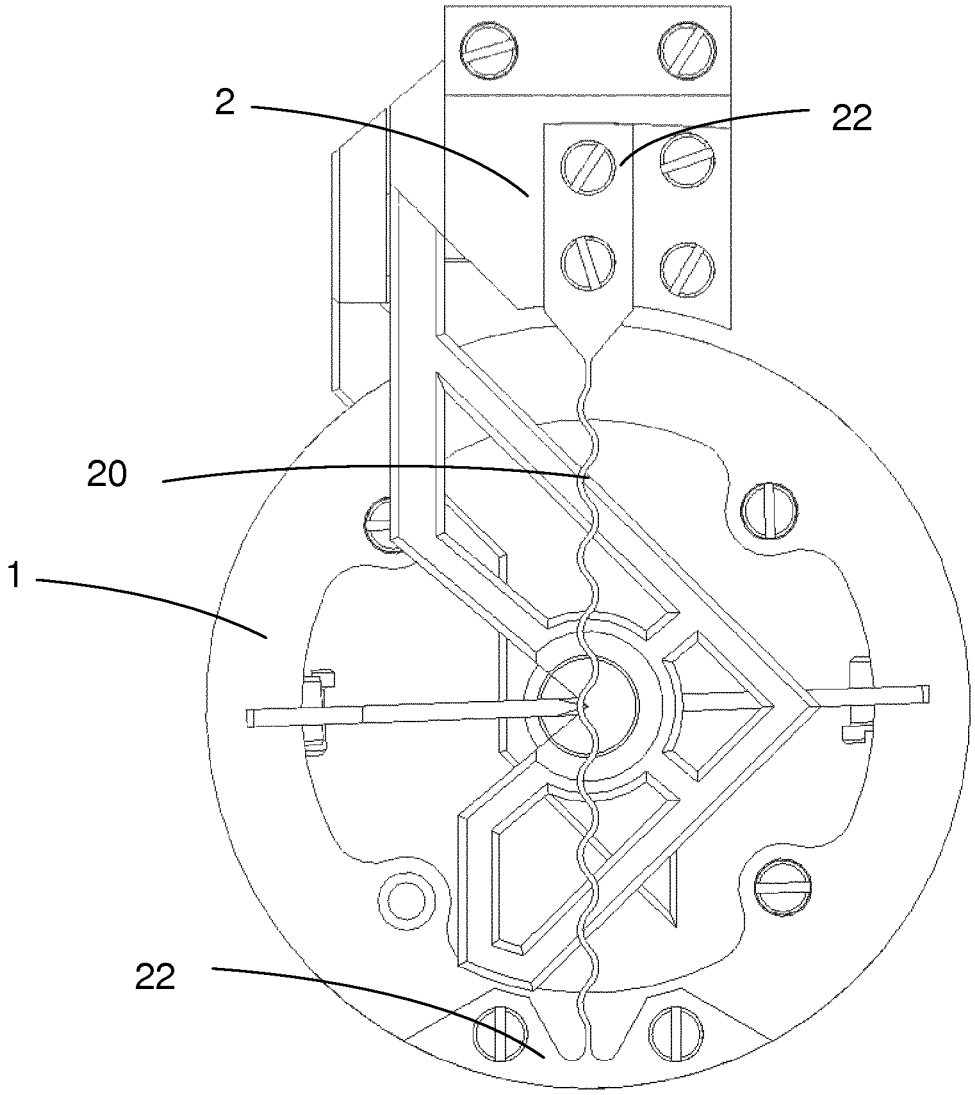

Thus, for example, FIG. 8 illustrates a pendulum pivoted by a blade pivot according to the invention, in which the elastic return member is a wire-spring 20, advantageously corrugated, one end of which is intended to be attached on a fixed element, secured to the part 2, such as a pendulum bridge for example, and the second end of which is attached in a shifted way relatively to the axis of the pivot, on the first part 1. Preferably, the second end is attached to the periphery of the part 1, preferably on the rim of the pendulum. For its attachment, the wire-spring comprises a heel 22 at each of its ends, giving the possibility of securing it by any means, such as screws for example.

The wire-spring passes through the axis of the pivot of the part 1, which in the case when the part 1 is cylindrical or circular, implies that the wire is substantially positioned on a diameter of the part 1. Advantageously, it was noticed that such an arrangement of the spring member allows rotation of the part 1 perfectly positioned on the axis of the pivot, although there is no elastic member connection with the part 1, on this axis.

The grooves 4 as illustrated in the figures, are dihedral. They may also assume other shapes, with a cylindrical surface extending in the direction of the axis of the pivot and allowing the blade supported in the groove to be positioned along directions perpendicular to the axis of the pivot. The shape of the contact area depends on the relative value of the radii of the thin edge of the blade and of the bottom of the groove. If the radius of the bottom of the groove is greater than that of the thin edge, the contact is accomplished on a single line and the blade 3 is uniquely positioned along the direction perpendicular to the axis of the pivot contained in the blade plane 10. If the radius of the bottom of the groove 4 is less than that of the thin edge, the contact is accomplished along two parallel lines and the blade 3 is also positioned transversely along a direction perpendicular to the axis of the pivot and to the blade plane 10. If the radii of the bottom of the groove 4 and of the thin edge of the blade are equal, like in the case illustrated in FIG. 3, the blade 3 is, like in the previous case, positioned along the directions orthogonal to the axis of the pivot. During pivoting, the blade 3 slides in the bottom of the groove 4. It may possibly roll in the case when the contact occurs on a single line. In the case of rolling, the relative movement of the first 1 and second 2 parts is assimilated to a rotation because of the very small radius of the thin edge of the blade.

According to a particular embodiment shown in FIG. 3, the thin edges of the blades and the bottoms of the grooves with the shape of a dihedron are axisymmetrical cylindrical shapes substantially with a same radius and are positioned so that the axis of revolution of the thin edges of the blades coincide. The radii of the bottom of the grooves may also be smaller than the radii of the thin edge of the blades. The axis of revolution common to the thin edges of the blades is the axis of the pivot. During pivoting of the first part 1 relatively to the second part 2, the thin edges of the blades 3 slide in the bottom of the grooves 4 in the same way as a traditional cylindrical axis slides in its bearing. However, in the case of the present invention, the radius of the thin edge of the blades may be strongly reduced comparatively to the radius of a traditional bearing axis, so that the resistant torque due to the friction of the blades in the grooves 4 is also strongly reduced. In other alternatives of the embodiment of FIG. 1, the axis of revolution of the thin edges of the blades in opposition may not exactly coincide or else are slightly shifted during the pivoting, since at least one blade 3 rolls on its supporting area. In these configurations, the pivoting remains possible with a permanent contact of the blades 3 on the supporting areas by a slight elastic deformation of at least one blade 3 or of an arm bearing the blade 3 or the supporting areas.

According to another embodiment not shown, the blades 3 may be distributed in several distinct planes, in particular the blades 3 may be regularly positioned along three planes forming together angles of 120°. In this case, the supporting areas may be planes perpendicular to the blade planes 10 in their equilibrium position.

According to another embodiment, the central blade 3 in opposition to both outer blades 3 may be reduced to a spike or vice versa both outer blades 3 may be reduced to spikes.

According to other embodiments, the first 1 and second 2 parts are secured in translation along the direction orthogonal to the axis of the pivot contained in the plane of the blade by a force from the return member exerting a return force, preferably in this direction and maintaining the blade 3 against the supporting area. Preferably, the return force passes through the axis of the pivot in order not to perturb the pivoting.

The return force may be obtained by the deformation of an elastic element, one end of which is for example attached at the axis of the pivot. It may also be obtained by a magnet exerting a magnetic attraction or repulsion force along the direction perpendicular to the axis of the pivot contained in the plane of the blade. For this, a magnet may be mounted secured to one of the first 1 or second 2 parts facing a ferromagnetic element with a shape of a circular arc centered on the axis of the pivot and secured to the other part, so that the air gap remains constant.

In the case when the supporting area is a groove 4, the bottom of which has a radius smaller than or equal to that of the thin edge of the blade, the return force maintains the blade 3 in the groove 4 and it is no longer necessary to provide several opposed blades 3 like in the embodiments of FIG. 1, in order to secure in translation the first 1 and the second 2 parts along the directions perpendicular to the axis of the pivot. It is possible to produce a pivot only including a single blade 3 and a single groove 4 like in the examples illustrated in FIGS. 5 to 7 wherein, the return forces pass through the axis of the pivot only in the equilibrium position illustrated for a reason which will appear subsequently.

Figure 4:
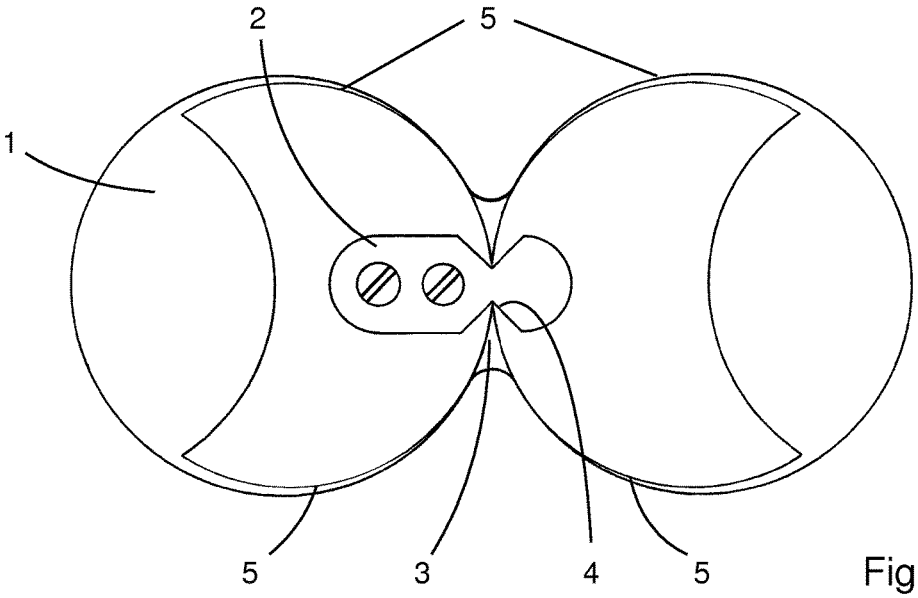

In another embodiment illustrated in FIG. 4, two blades 3 facing each other and borne by the first part 1, will be supported in two grooves 4 secured to the second part 2, by defining two distinct and parallel pivot axes. The blades are mounted on elastically deformable arms 5 which the first part 1 includes and which tend to bring the blades 3 closer to each other by exerting opposite return forces, perpendicular to the axes of the pivots and contained in the plane of the blades. These return forces maintain the blades 3 bearing against each other in the bottom of the grooves 4. Moreover, the arms 5 elastically deform during the relative displacement of the first 1 and second 2 parts around both axes of rotation by tending to bring back both parts into their equilibrium position illustrated in FIG. 4. This device forms a resonator wherein the first part 1 is a pendulum and the arms 5 store energy in elastic form and give it back in a kinetic form during oscillations.

Figure 5:
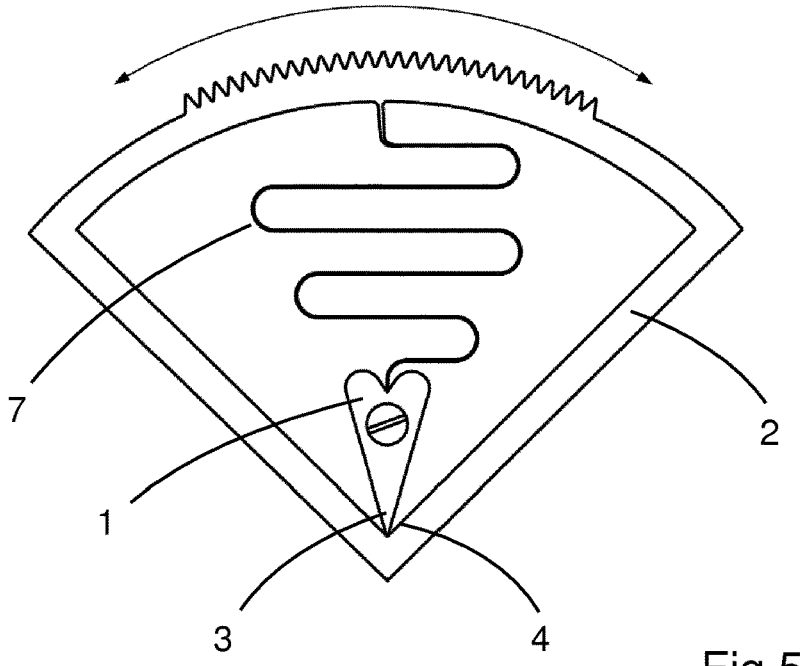
Figure 6:
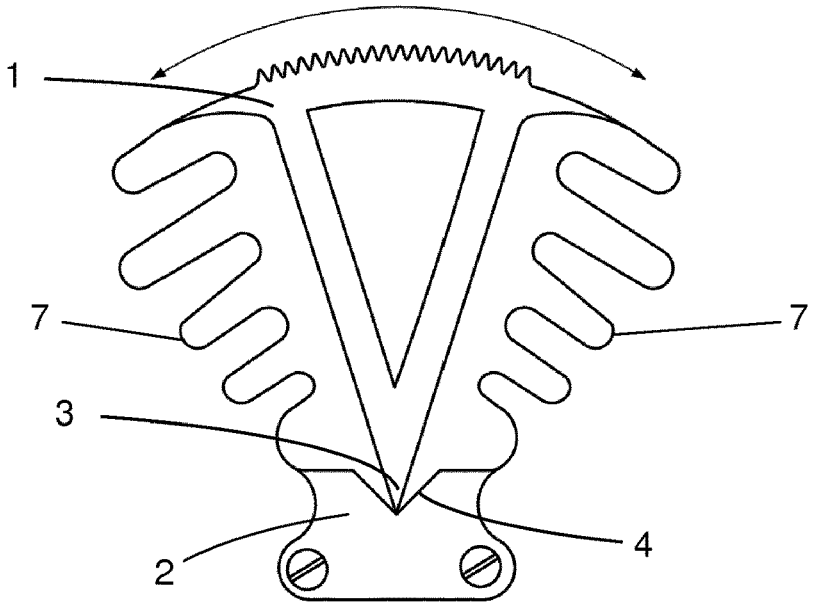
Figure 7:
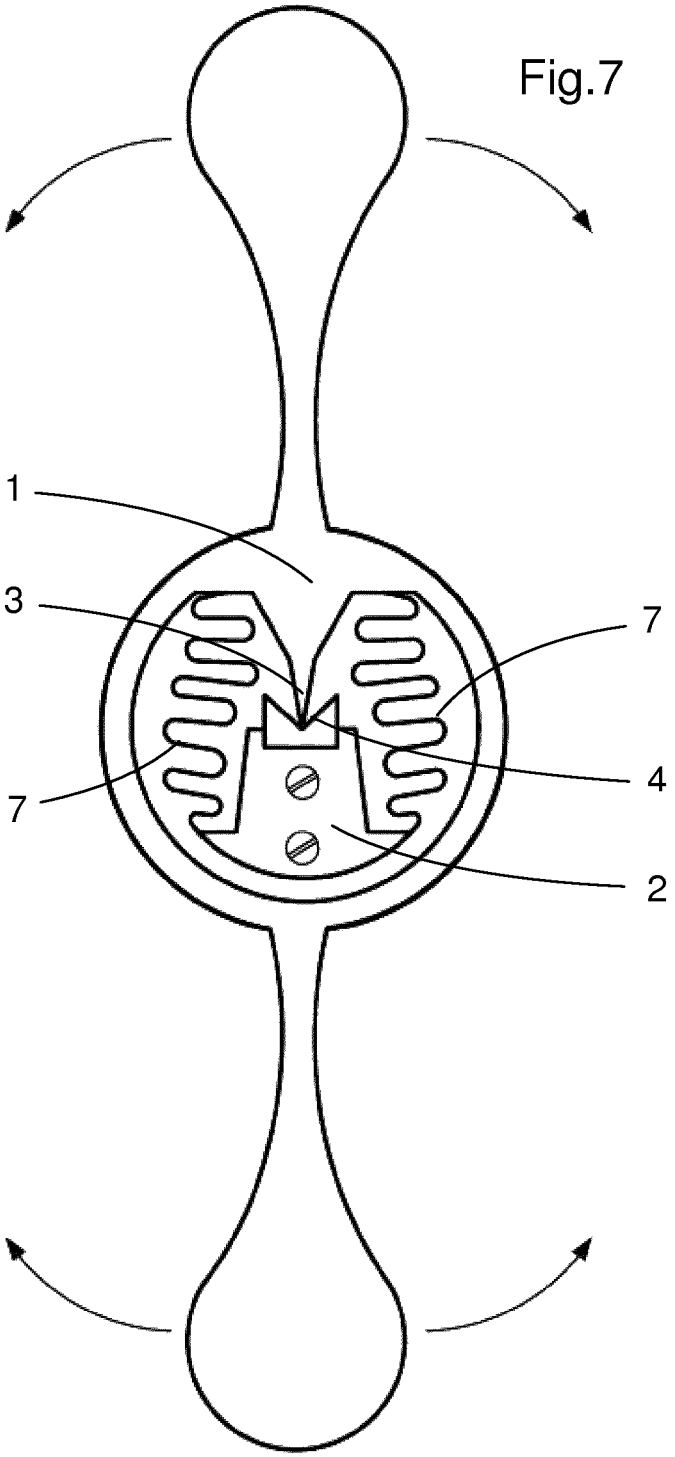

FIGS. 5, 6 and 7 show other configurations of a pivot and/or a resonator according to the invention. The first 1 and second 2 parts include a blade and a groove defining a pivot connection and are connected through one or several elastic return members 7. Said elastic return members 7 have the dual function of maintaining the blade 3 bearing against each other in the bottom of the groove 4, as this was explained earlier, and of storing and giving back the energy respectively in an elastic and kinetic form. For this reason, the return force does not pass through the axis of the pivot when the first 1 and the second 2 parts are not in the illustrated equilibrium position and exerts a return torque tending to bringing them back into their equilibrium position. In other embodiments not shown, the return member may be formed with one or several magnets operating in attraction or in repulsion.

The low resistance to the pivoting of a blade pivot according to the invention gives the possibility of obtaining a high quality factor for a resonator including such a pivot. It is thus possible to use a relatively heavier pendulum than the pendulums of the state of the art, without any insurmountable negative effect at the friction to the pivots. For example, it is possible to produce a pendulum for which the serge is made on the basis of or with an alloy including a dense material, in order to increase the timekeeping qualities of the resonator, without increasing its dimension. Thus, the pendulum, or at least its serge or a portion of its serge, may be produced from the following materials or from their alloys: gold, platinum, osmium or any other material of very high density (greater than 15, preferably greater than 19).

According to a third aspect of the invention, it is possible to produce an oscillator incorporating a resonator according to the invention, the supply of which may be accomplished for example with a pulse mechanism of the "lost to stroke" type wherein the pulse period is a multiple of the oscillation period and which thus perturbs to the very least the isochronism.

The pendulum is formed with the second part 2 in the embodiment of FIG. 5 and by the first part 1 in those of FIGS. 6 and 7. Particularly with such a lost stroke escapement, a pendulum as mentioned above, including a serge made on the basis of the materials above with the density of more than 15, preferably more than 19, is highly advantageous for use. However its use may be found with any escapement, notably of the Swiss anchor type.

In the whole of the shown embodiments, it is possible to swap each blade 3 with the corresponding supporting area. Thus, the blades may be equally found on the first 1 or on the second 2 part or else further distributed among both of them.

Equally, one of the first 1 or second 2 parts may be secured to an element of the frame of the timekeeper.

The whole of the components described, i.e. notably the first and second parts, the blades, the grooves, the arms and the elastic members may be made in several elements or in a monolithic way.

The invention claimed is:

1. A timekeeper pivot comprising a first part and a second part pivotally connected around a pivot axis, the pivot including at least one blade provided with an edge, the blade secured to one of the first or second parts and the median plane of which passing through the edge defines a blade plane, and a groove secured to the other of the first and second parts and against a bottom surface of the groove which bears the edge of the blade, the contact points of the blade and of the bottom surface of the groove being located on the axis of the pivot, wherein the first and second parts are secured in translation along a direction orthogonal to the axis of the pivot contained in the blade plane further comprising a spike for limiting the relative displacement of the first and second parts in translation along the pivot axis.

2. The pivot according to claim 1, wherein the first and second parts are secured in translation along all directions orthogonal to the axis of the pivot.

3. The pivot according to claim 2, wherein the edge of the blade is an axisymmetrical cylinder and in that the axis of the cylindrical surface of the edge of the blade coincides and form the axis of the pivot.

4. The pivot according to claim 1, wherein the spike is integrated to the blade.

5. The pivot according to claim 1, further comprising a plurality of blades secured to one of the first and second parts and a plurality of grooves secured to the other one of the first and second parts and upon which the blades will bear, the contact points of the blades and of the grooves being substantially located on the axis of the pivot.

6. The pivot according to claim 1, further comprising three blades located in a same plane.

7. The pivot according to claim 1, wherein said groove or blade is borne by an elastically deformable arm which the first or the second parts includes.

8. The pivot according to claim 1, further comprising a return member laid out so as to exert a return force tending to maintain the blade bearing against the groove.

9. The pivot according to claim 8, wherein the return member is laid out so that the return force is directed along the direction contained in the blade plane and orthogonal to the axis of the pivot.

10. The pivot according to claim 8, wherein the return member is an elastic member.

11. The resonator according to claim 10, wherein the return member exerts a return force tending to maintain the blade bearing against the groove.

12. The resonator according to claim 10, wherein the return member is a wirespring, one end of which is secured to the second part and the second end of which is attached in a shifted way relatively to the axis of the pivot on the first part.

13. A timekeeper oscillator including a resonator according to claim 10.

14. A timekeeper resonator including a pendulum provided with a pivot and a return member for storing and giving back energy tending to bring back the pendulum in an equilibrium position, wherein the pivot of the pendulum is a pivot according to claim 1.

15. The pivot according to claim 1, wherein the groove has a substantially dihedron shape.

* * * * *